US005715567A

United States Patent [19]

Tagliaferri

[11] Patent Number: 5,715,567

[45] Date of Patent: Feb. 10, 1998

[54] VEHICLE FOR DUST AND TRASH COLLECTING

[75] Inventor: Fabrizio Tagliaferri, Trecasali, Italy

[73] Assignee: Duvelo International S.P.A., Parma, Italy

[21] Appl. No.: 642,284

[22] Filed: May 3, 1996

[30] Foreign Application Priority Data

Mar. 14, 1996 [IT] Italy ..... MI96U0185

[51] Int. Cl.[6] ..... E01H 1/08

[52] U.S. Cl. ..... 15/340.3; 15/49.1; 15/82; 15/87; 15/349

[58] Field of Search ..... 15/340.3, 340.4, 15/82, 87, 349, 49.1, 52.1

[56] References Cited

U.S. PATENT DOCUMENTS

| | | | |
|---|---|---|---|
| 3,186,015 | 6/1965 | Beyerstedt | 15/87 X |
| 3,242,521 | 3/1966 | Young . | |
| 3,790,981 | 2/1974 | Young | 15/87 |
| 3,886,624 | 6/1975 | Landesman et al. | 15/340.3 X |
| 4,125,915 | 11/1978 | Zamboni | 15/52.1 X |
| 4,138,756 | 2/1979 | Krier et al. | 15/340.3 X |
| 4,951,347 | 8/1990 | Star et al. | 15/340.3 |
| 5,564,147 | 10/1996 | Young | 15/340.4 X |

FOREIGN PATENT DOCUMENTS

| | | |
|---|---|---|
| 2455200 | 5/1976 | Germany . |
| 666711 | 8/1988 | Switzerland . |

*Primary Examiner*—Chris K. Moore
*Attorney, Agent, or Firm*—Browdy and Neimark

[57] ABSTRACT

A vehicle for dust and trash collecting comprises: wheels, a framework supported by said wheels, a storage tank (8) for dust and trash, at least one rotating brush (10), means (6) for setting said wheels in motion, and control means (7) comprising a fluid-operated work circuit (26), at least one peripheral motor (33) fed from the work circuit (26) and engaging the rotating brush (10), at least one fluid-operated cylinder (39) fed from the work circuit (26) and adapted to shift the rotating brush (10) towards a surface (11) to be swept, and elastically deformable members (42) active against the action of said work circuit (26) in the fluid-operated cylinder (39) and adapted to lift up the rotating brush (10) in the absence of pressure in the fluid-operated cylinder (39) itself, the work circuit (26) having a single control element (29) for actuation of the peripheral motor (33) and the fluid-operated cylinder (39).

10 Claims, 3 Drawing Sheets

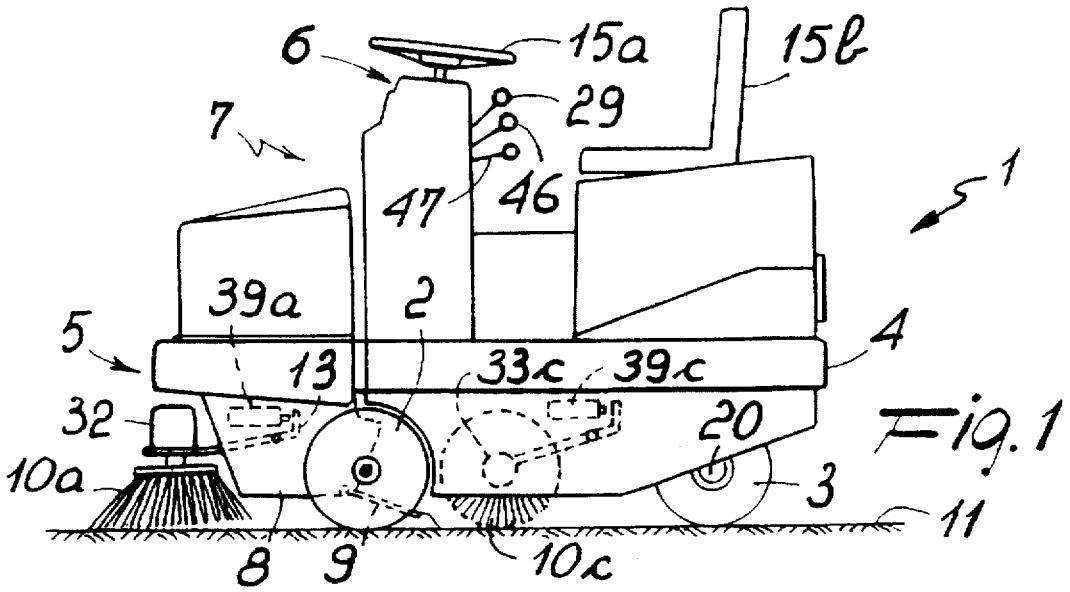
Fig. 1
Fig. 2
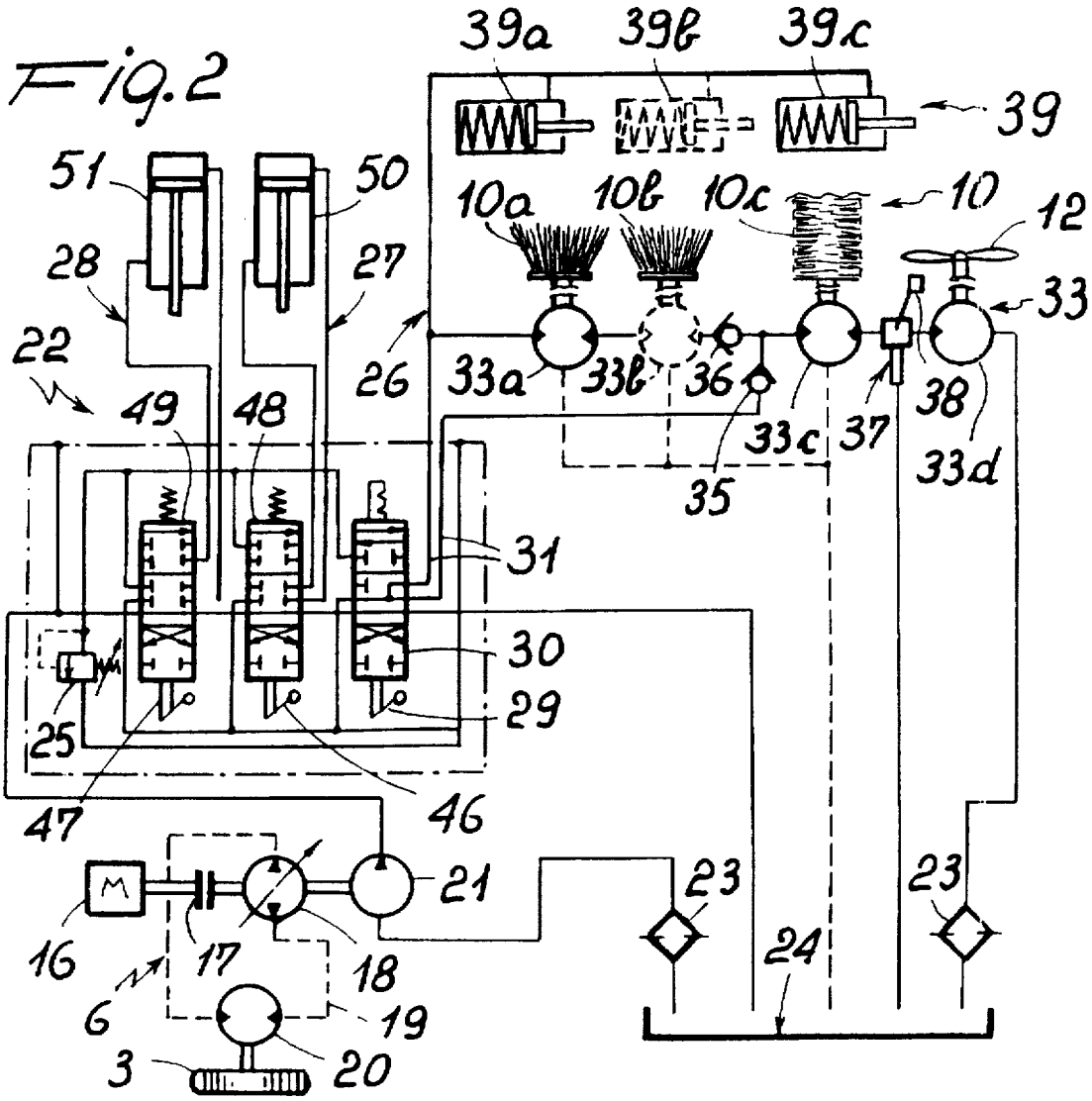

VEHICLE FOR DUST AND TRASH COLLECTING

BACKGROUND OF THE INVENTION

The invention relates to a vehicle for dust and trash collecting.

It is known that vehicles for dust and trash collecting can be either of small sizes and low cost and adapted for cleaning floorings in stores, sheds and the like, or of larger sizes and higher costs being also suitable for cleaning streets and residential districts.

Depending on their sizes and structural features, these vehicles are used and driven by more or less qualified operators.

In particular, it has been found that small-vehicles and medium-sized vehicles are in many cases used by unskilled operators, that only occasionally have the task of driving said vehicles.

The possible presence of unskilled operators makes it necessary to manufacture vehicles capable of reducing driving and control errors to a minimum.

These errors very often include an incomplete deactivation of the brushes acting on the ground for conveying dust and trash to appropriate suction members, for example.

In fact, in an ordinary medium-sized vehicle of the above type, at the beginning of each work cycle the operator starts the motor of a dust sucking fan and the motors setting in rotation one or two front side brushes in the form of a cup or a truncated cone, as well as a cylindrical or roller brush adapted to throw dust and trash into a storage tank.

In addition the operator actuates the members setting the different brushes to the work position, that is those members that lower said brushes to a position in which they are in contact with the surface to be swept or cleaned.

At the end of the cleaning operations, before the vehicle is moved for discharging of the collected rubbish and sheltering of the vehicle in a depot, said motors must be stopped and said brushes must be lifted up again.

Lifting and lowering of the brushes takes place by means of actuators of different types the intervention of which is to be controlled from the driving seat.

Lifting of the brushes at the end of work is necessary because, should they stay in the lowered position while the vehicle is moving at a relatively high speed for carrying out transfer, a strong and uneven wear of the brush bristles would occur.

When the brushes rest on the ground there is also the risk that they may get damaged due to unintentional shocks between the brushes themselves and the surrounding environment, since at least some of these brushes definitely project from the overall plan dimensions of the vehicle.

Vehicles having a simpler structure can have a rotating brush alone, of the type in the form of a truncated cone for example, projecting from the fore end of the vehicles themselves to convey dust and trash to sucking members located more rearwardly.

However, even if only one rotating brush is concerned, the above mentioned problems remain unchanged.

Rather, it is more likely that a single brush will be left in contact with the ground because positioning of same in a vertical direction is often carried out by the operator himself acting manually on the brush.

Forgetting the brushes in a lowered position at the end of work is a mistake occurring rather often when the operators are not very skilled because when an operator stops rotation of the brushes the noise they usually produce stops at once too, and he has the impression that no further operations are needed.

The arrangement of special brush-lifting controls does not obviate the above mistake in a sure manner, since an operator can always neglect said controls.

In addition it is to note that in any case complicated structures are not satisfactory, in that they are inappropriate to vehicles of a simpler type, that is exactly those vehicles that are commonly used by unskilled operators.

SUMMARY OF THE INVENTION

Under this situation, the technical task underlying the present invention is to devise a vehicle capable of substantially obviating the mentioned drawbacks of the known art.

The technical task mentioned above is substantially achieved by a vehicle for dust and trash collecting comprising: wheels, a framework supported by said wheels, a storage tank for dust and trash, dust and trash collecting members comprising at least one rotating brush, means for setting the wheels in motion, and control means for said collecting members, said control means comprising: a fluid-operated work circuit, at least one peripheral fluid-operated motor fed from said work circuit and engaging in rotation said at least one rotating brush, at least one fluid-operated cylinder fed from said work circuit and adapted to move said at least one rotating brush towards a surface to be swept, and elastically deformable members active against the action of said work circuit in said at least one fluid-operated cylinder and adapted to lift up said at least one rotating brush in the absence of pressure in said at least one fluid-operated cylinder, said work circuit having a single control element to actuate both said at least one peripheral motor and said at least one fluid-operated cylinder.

BRIEF DESCRIPTION OF THE DRAWINGS

The features and advantages of the invention will become apparent from the following detailed description of a preferred embodiment of same, taken with reference to the accompanying drawings, in which:

FIG. 1 is a diagrammatic elevational side view of the vehicle of the invention taken as a whole;

FIG. 2 particularly shows the control means for the collecting members of the vehicle shown in FIG. 1;

DETAILED DESCRIPTION OF THE INVENTION

Figure 3:
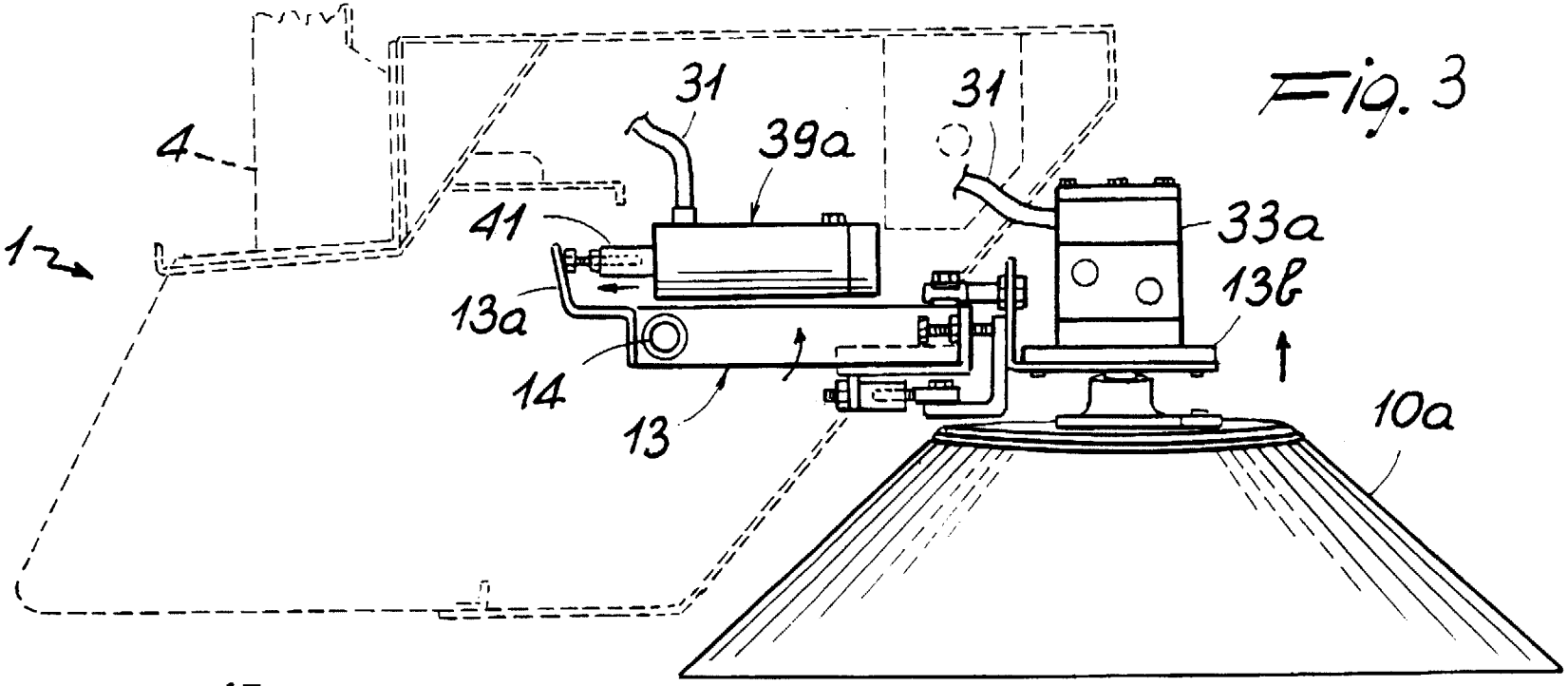
FIG. 3 shows the structure of a vehicle portion at a front side brush, represented in a raised position.

With reference to the drawings, the vehicle of the invention is generally identified by reference numeral 1.

Briefly, in the case herein shown it comprises three wheels resting on the ground: two front wheels 2 and one rear wheel 3. The rear wheel 3 is both a driving and steering wheel.

The wheels 2, 3 support a framework 4 carrying dust and trash collecting means 5, means 6 for movement of the vehicle 1, means 7 for controlling the collecting members 5, and a tank 8 for dust and trash storage.

The tank 8 is substantially placed between the front wheels 2 and is provided with an opening and closing door 9 also adapted to perform the function of a chute for introduction of dust and trash into the tank.

The collecting members 5 comprise one or more rotating brushes 10 adapted to operate on a surface 11 to be swept.

In the preferred embodiment herein depicted three rotating brushes 10 are provided. Exactly, as shown, there are a first rotating brush 10*a*, an auxiliary rotating brush 10*b* and a second rotating brush 10*c*.

The first rotating brush 10*a* and the auxiliary rotating brush 10*b* are shaped in the form of a cup or a truncated cone and have a rotation axis transverse to the surface 10. In addition they are positioned at the front and on opposite flanks of the vehicle, so as to convey dust and trash to the central region of the vehicle itself. In many cases the auxiliary rotating brush 10*b* is not necessary and therefore it is only shown in chain line in FIG. 2.

The second rotating brush 10*c* is on the contrary of cylindrical form or a roller brush, having its rotation axis substantially horizontal, and is positioned in the central region of vehicle 1.

When the door 9 is lowered as shown in FIG. 1 and the tank 8 is open, the second rotating brush 10*c* throws into the tank 8 the dust and trash conveyed thereto by the first rotating brush 10*a* and the auxiliary rotating brush 10*b*, if present.

The collecting members 5 comprise a sucking fan 12 located upstream of the tank 8 and, upon interposition of a filter, adapted to suck the air from the tank 8 in order to prevent the dust from coming out of the tank 8 and spreading into the surrounding atmosphere, and also to carry out an efficient sucking function extending until over the surface 11.

The framework 4 performs the function of oscillatably supporting the collecting members 5 consisting of the rotating brushes 10, to enable raising and lowering of said rotating brushes 10 relative to the surface 11 to be swept. In fact, as diagrammatically shown in FIG. 1 and in detail in FIGS. 3 to 6, each of the rotating brushes 10 is supported by a swinging arm 13.

In particular, each of the rotating brushes 10 engages a supporting end 13*b* of the arm 13, opposite to an operating end 13*a* thereof, at which control of said oscillations occurs, as stated in the following.

The arm 13 is pivotally mounted between the operating end 13*a* and the supporting end 13*b* by means of a pin 14 disposed in such a manner that it makes the swinging arm 13 movable in a substantially vertical plane.

For operation and control of the wheels 2 and 3 of vehicle 1, said movement means 6 comprises a drive equipment known per se, the steering wheel 15*a* and the related driving seat 15*b* of which are shown in FIG. 1, and a traction apparatus shown in FIG. 2, provided with a main motor 16 engaging a fluid-operated traction pump 18 through driving members 17.

Connected with the fluid-operated traction pump 18 is a fluid-operated traction system 19 with which a fluid-operated traction motor 20 is in turn connected, which motor engages the rear driving wheel 3.

The main motor 16 may be an endothermic motor or an electric motor.

For actuation of the collecting members 5, control means 7 comprises a fluid-operated work pump 21 and a fluid-operated work system 22.

The fluid-operated work system 22 is shown in FIG. 2 where one can see that the system pipelines are connected, through appropriate filters 23, to a container 24 for working oil.

The fluid-operated work system 22 comprises three circuits in parallel to each other, controlled by a maximum-limiting valve 25 and formed of a work circuit 26 and a first and a second auxiliary circuits 27 and 28, respectively.

The work circuit 26 actuates all collecting members 5 and has a single control element: a first lever 29 operating a first distributor 30 from which first pipelines 31 extend.

Connected with said first pipelines 31 is one or more peripheral motors 33 of the fluid-operated type.

In the embodiment shown, four peripheral motors 33 are identified. Indeed, there are a first peripheral motor 33*a*, an auxiliary peripheral motor 33*b*, a second peripheral motor 33*c*, and finally a third peripheral motor 33*d*.

Figure 5:
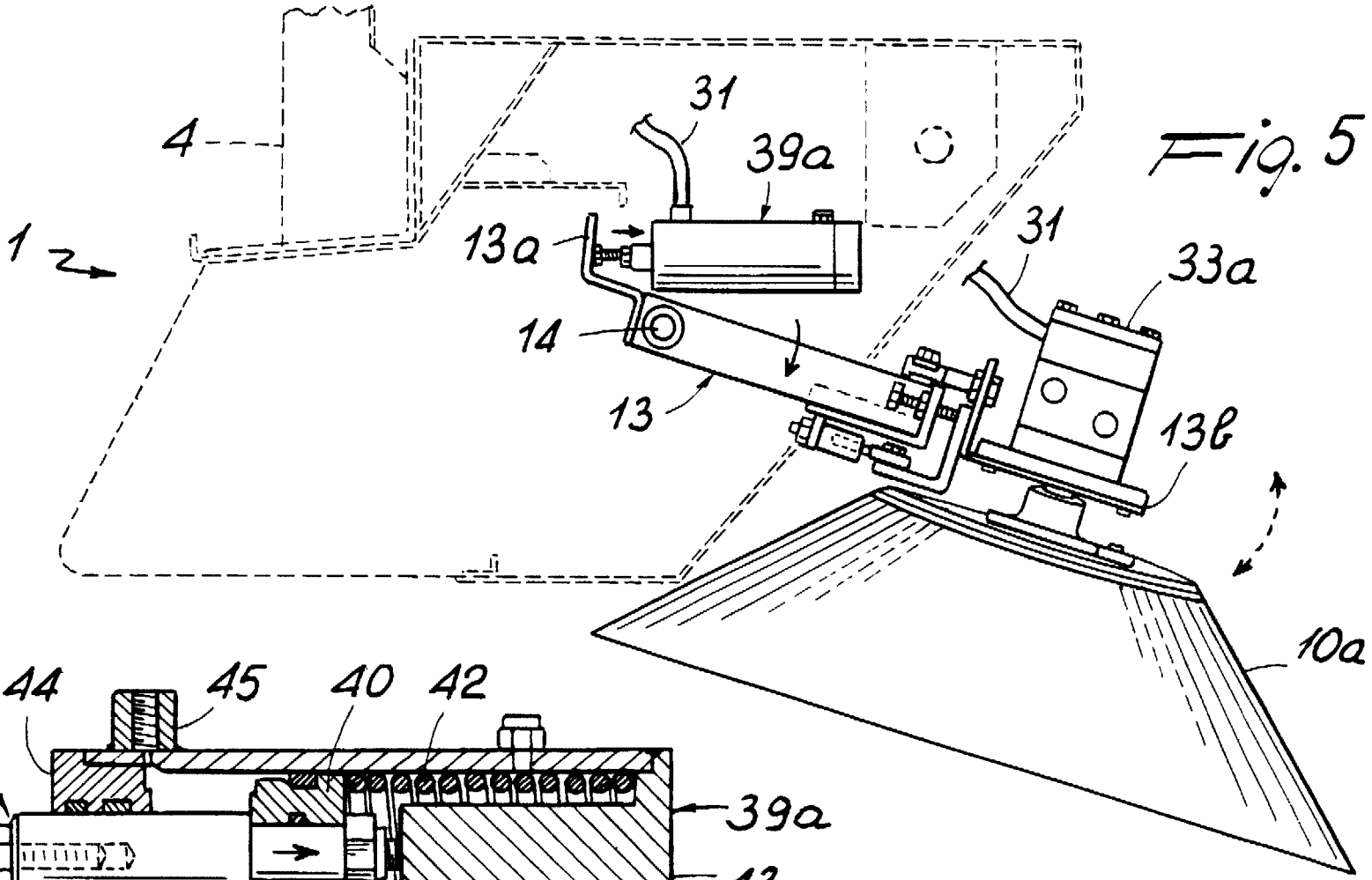
FIG. 5 is similar to FIG. 3, but it shows said brush in a lowered position.

The first peripheral motor 33*a* is adapted to rotate the first rotating brush 10*a*, and it is mounted coaxially with said brush, as shown in detail in FIGS. 3 and 5.

The auxiliary peripheral motor 33*b* is similar to the first one and is intended for rotation of the auxiliary rotating brush 10*b*. In the same manner as said auxiliary brush, the auxiliary peripheral motor 33*b* can be omitted too and therefore it is shown only in chain line.

The second fluid-operated peripheral motor 33*c* is adapted to set in rotation the second rotating brush 10*c* which is a roller brush, and it is mounted coaxially therewith for example, as shown in phantom lines in FIG. 1.

Finally, the third peripheral motor 33*d* is adapted to set the sucking fan 12 in rotation.

Still with reference to the work circuit 26, it is pointed out that two check valves 35 and 36 are present therein for suitably preventing refluxes to the first pipelines 31.

It is to note that the third peripheral motor 33*d* can be isolated by a diverting element 37 operable by a lever 38 and capable of bypassing to the container 24, the oil directed to the third peripheral motor.

Still for actuation of the collecting members 5, the control means 7 further comprises one or more fluid-operated cylinders 39, located along the work circuit 26.

In the embodiment shown provision is made for three or more fluid-operated cylinders.

Identified therein is in fact a first fluid-operated cylinder 39*a*, an auxiliary fluid-operated cylinder 39*b*, shown in chain lines in FIG. 2, and a second fluid-operated cylinder 39*c*.

The first fluid-operated cylinder 39*a* is associated with the first rotating brush 10*a*, the auxiliary fluid-operated cylinder 39*b* is associated with the auxiliary rotating brush 10*b*, and the second fluid-operated cylinder 30*c* is associated with the second rotating brush 33*c*.

All the above mentioned fluid-operated cylinders 39 substantially have the same structure as the first fluid-operated cylinder 39*a* shown in FIGS. 3 to 6.

It is pointed out that each fluid-operated cylinder 39 is fed from the work circuit 26, is provided with a movable piston 40 located inside it and integral with a rod 41, and is associated with elastically deformable members 42 acting on the piston 40 against the action of the work circuit 26.

The elastically deformable members 42 can be disposed in any manner and in the embodiment shown in the drawing they are located inside the fluid-operated cylinders 39 and are embodied by a compression spring extending between the piston 40 and one end 43 of the fluid-operated cylinders 39.

The second end 44, opposite to the first one, is instead connected to an attachment 45 for the pipelines 31, so that insertion of working oil is allowed between the piston 40 and the second end 44.

The rod 41 passes through the second end 44 and is of an adjustable length, due to the presence of a ferrule 41*a* to be axially screwed down in the rod 44 itself.

Figure 4:
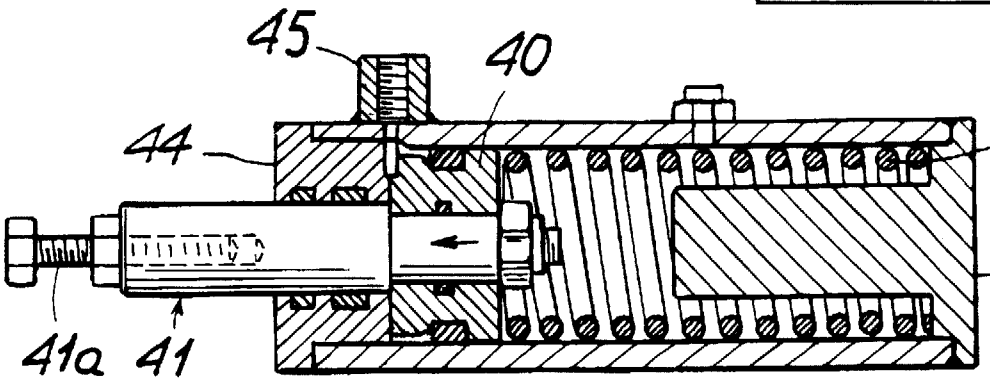
FIG. 4 is a cross-sectional view of the cylinder shown in FIG. 3, to an enlarged scale.

As shown in FIGS. 3 and 5, the first fluid-operated cylinder 39*a*, in the same manner as all the fluid-operated cylinders 39, is fastened to the vehicle 1 above the corresponding swinging arm 13, so as to cause engagement between the operating end 13*a* of the arm 13 and the ferrule 41*a*, by mutual abutment. If the rod 41 is in a position of maximum extension due to the action of the compression spring 42, as shown in FIG. 4, said rod 41 pushes the operating end 13*a* to such an extent that the rotating brush is maintained in a raised position relative to surface 11 (FIG. 3).

Practically, the compression spring 42 acts against the action exerted by the weight of the first rotating brush 10*a* and the first peripheral motor 33*a*, said weight tending to cause lowering of the brush 10*a* towards the surface 11.

Figure 6:
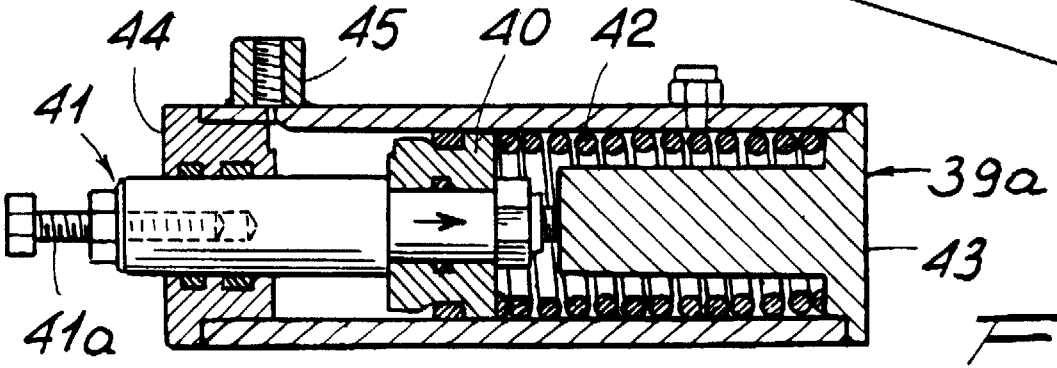
FIG. 6 is a cross-sectional view of the cylinder shown in FIG. 3, to an enlarged scale.

In the position in FIG. 6 the rod 41 is at its minimum degree of projection and the compression spring 42 is compressed to the most by piston 40, which is under the action of the oil present in the work circuit 26.

The rod being in this position of minimum projection, the weight of the first rotating brush 10*a* and the first peripheral motor 33*a* can cause rotation of the arm 13 about the pin 14, thereby causing the first rotating brush 10*a* to rest on the surface to be swept in an inclined position.

Inclination of the first rotating brush 10*a* and the auxiliary brush 10*b* relative to the surface to be swept is a necessary requirement to enable these brushes to operate without creating vortices.

No inclination occurs with the second rotating brush 10*c* in the form of a roller and having a horizontal axis.

The lowered position of the rotating brushes 10 is not fixed and these brushes can freely move upwardly in case of unevenness of the ground, since the ferrule 41*a* is not integral with the operating end 13*a* of the arm 13.

As already pointed out, the fluid-operated work system 22, in addition to the above described work circuit 26, further comprises a first auxiliary circuit 27 and a second auxiliary circuit 28.

Said auxiliary circuits 27 and 28 are controlled by a second lever 46 and a third lever 47 respectively, shown in FIGS. 1 and 2. These levers 46 and 47 operate, through a second distributor 48 and a third distributor 49, a first and a second fluid-operated actuator 50 and 51 respectively, which are known per se and are double-acting cylinders for example.

The first and second fluid-operated actuators 50 and 51 are intended for raising and lowering of the tank door 9 and lifting and lowering of the whole tank 8 relative to the framework 4, when emptying of the tank into a rubbish skip or the like is necessary.

Operation of vehicle 1 is as follows.

At the beginning of a work cycle, an operator drives the vehicle 1 to the place where dust and trash collecting is to be carried out, a shed or a store for example.

When the work place has been reached, the operator actuates the collecting members 5 by merely moving the first lever 29 that immediately causes lowering of all rotating brushes 10 in a vertical direction, and setting in rotation of said brushes and the sucking fan 12.

Only when the brushes operate on wet surfaces and therefore suction may cause drenching of the filters and, as a result, damage of same, intervention of the diverting element 37 by means of lever 38 is possible, and in this manner actuation of the sucking fan 12 is avoided.

In particular, the oil circulation within the work circuit 26 leads to a downward displacement of the rotating brushes 10, since the insertion of oil into the fluid-operated cylinders 39 causes the piston 40 to be pushed against the action of the compression spring 42, so that said spring is compressed and the rod 41 is retracted. Thus the rotating brushes 10 are free to come down due to their own weight.

At the end of the operations for dust and trash collecting, it is only necessary to discharge the tank 8.

The required operations are closing of the tank door 9 by the second lever 46 and lifting of the tank 8 over a rubbish skip or the like by the second lever 47.

At the end of the collecting operations and before moving the vehicle 1 to the discharge place, it is however necessary to carry out a complete deactivation of the collecting members: as already said, in the devices of the known art it often happens that the brush rotation is stopped, but the brushes are then left in contact with the ground, since said brushes become immediately noiseless and the operator forgets to lift them up.

Thus the transfer movements of the vehicle 1 give rise to a strong and uneven wear of the brush bristles.

In addition, since at least the first rotating brush 10*a* projects from the vehicle, shocks of the brush against parts of the surrounding environment may occur, which will further damage the brush and also cause damages to other external structures.

When the inventive vehicle 1 is used, forgetting to lift the brushes up is impossible: in fact, at the end of the collecting step, operation of the first lever 29 simultaneously causes stopping of the brushes and lifting of same.

The simultaneous stopping and lifting of the brushes also takes place when in the work circuit 26 interruptions occur in the oil circulation.

It is to note in fact that, on the one hand, the peripheral motors 33 cannot work in the absence of an oil flow and, on the other hand, in the fluid-operated cylinders 39 the intervention of the compression spring 42 takes place automatically: if the oil pressure is lacking, the compression spring 42 is capable of pushing the piston 40 until its end-of-stroke position, making the rod 41 project, which rod, acting against the action of arm 13, urges the respective rotating brush to move up from the ground.

The invention achieves important advantages.

In particular, it is pointed out that the vehicle of the invention offers a substantially errorproof control.

In addition, arrangement of the collecting members in a rest position occurs in an automatic manner even in case of failure in the work circuit 26. In this case, in fact, the vehicle itself takes the best arrangement for transferring to a repair shop.

Furthermore, it is to note that the work circuit causing lowering of the rotating brushes does not exert a locking action on said brushes and it does not even force them to the lowered position.

On the contrary, in a work position the brushes are conveniently moved close to the surface to be swept only by effect of their own weight and the weight of the related peripheral motors and said brushes are free to oscillate in a vertical direction.

The fact that the rotating brushes are free to oscillate up and down during the dust and trash collecting step brings about the important advantage that said brushes, as regards their position, spontaneously adapt themselves to the surface to be swept.

Thus, no difficulties arise in case of differences of level in the ground or presence of platforms.

Finally, the vehicle structure is simple and adaptable to different requirements: for example, the dust and trash collecting members can be of any type and the fluid-operated system can be structured in different manners.

In particular, a work circuit operating with high inner pressures it not required, because a light effort may be sufficient for overcoming the action of the compression springs: the work circuit acts in the same direction as the weight force of the peripheral motors and the brushes and if the compression springs are such calibrated that they overcome the weight force by a little value, pressure in the work circuit may be very reduced.

I claim:

1. A vehicle for dust and trash collecting comprising: wheels (2, 3), a framework (4) supported by said wheels (2, 3), a storage tank (8) for dust and trash, dust and trash collecting members (5) comprising at least one rotating brush (10), means (6) for setting said wheels (2, 3) in motion and control means (7) for said collecting members (5), said control means (7) comprising:

a fluid-operated work circuit (26), at least one peripheral fluid-operated motor (33) fed from said work circuit (26) and engaging in rotation said at least one rotating brush (10), at least one fluid-operated cylinder (39) fed from said work circuit (26) and adapted to move said at least one rotating brush (10) towards a surface (11) to be swept, and elastically deformable members (42) active against the action of said work circuit (26) in said at least one fluid-operated cylinder (39) and adapted to lift up said at least one rotating brush (10) in the absence of pressure in said at least one fluid-operated cylinder (39), said work circuit (26) having a single control element (29) to actuate both said at least one peripheral motor (33) and said at least one fluid-operated cylinder (39).

2. A vehicle as claimed in claim 1, wherein said at least one fluid-operated cylinder comprises a movable piston (40) and a rod (41) integral with said piston (40), and wherein said elastically deformable members (42) are embodied by a compression spring internal to said at least one cylinder (39) and active on said piston (40) against the action of said work circuit (26).

3. A vehicle as claimed in claim 2, wherein at least one swinging arm (13) is provided, which arm is pivotally mounted to said framework (4) and carries said at least one rotating brush (10), and wherein said rod (41) embodies a calibrated stop for the displacements of said at least one swinging arm (13) caused by the weight of said at least one rotating brush (10).

4. A vehicle as claimed in claim 3, wherein said work circuit (26) is active on said piston (44) in a manner adapted to press said compression spring (42) and to cause an at least partial retraction of said rod (41) in said at least one fluid-operated cylinder (39), lowering of said at least one rotating brush (10) being allowed by the retraction of said rod (41) in said at least one fluid-operated cylinder (39).

5. A vehicle as claimed in claim 3, wherein said rod (41) is of adjustable length.

6. A vehicle as claimed in claim 3, wherein said at least one swinging arm (13) has a free supporting end (**13*b*) carrying said at least one rotating brush (10) and said at least one peripheral motor (33), and an operating end (13*a*) movable against the abutment action of said rod (41), wherein a pin (14) is arranged between said operating end (13*a*) and supporting end (13*b*), which pin rotatably links said at least one swinging arm (13) to said framework (4), and wherein the weight of said at least one rotating brush (10) and said at least one peripheral motor (33) is adapted to cause rotation of said at least one swinging arm (13) in a direction opposite to that imposed by said rod (41) projecting from said at least one fluid-operating cylinder (39), by the action of said compression spring (42**).

7. A vehicle as claimed in claim 1, wherein said at least one rotating brush (10) is a brush of the type in the form of a truncated cone and having a substantially vertical axis of rotation.

8. A vehicle as claimed in claim 1, wherein said dust and trash collecting members (5) comprise a plurality of rotating brushes (10), a plurality of peripheral motors (33), one for each of said rotating brushes (10), and a plurality of fluid-operated cylinders (39) adapted to cause lifting and lowering of said rotating brushes (10) relative to a surface (11) to be swept, and wherein all said peripheral motors (33) and fluid-operated cylinders (39) are fed from said work circuit (26) and interlocked to said single control element (29).

9. A vehicle as claimed in claim 1, wherein said dust and trash collecting members (5) further comprise a sucking fan (12) adapted to create a sucking air stream passing through said tank (8), wherein a third peripheral motor (**33*d*) is provided for rotation of said sucking fan (12), and wherein said third peripheral motor (33*d*) too is moved by said work circuit (26) and interlocked to said single control element (29**).

10. A vehicle as claimed in claim 1, wherein said single control element (29) is a lever engaging a working-oil distributor (30).

* * * * *